US006948688B1

(12) United States Patent
Payne et al.

(10) Patent No.: US 6,948,688 B1
(45) Date of Patent: Sep. 27, 2005

(54) FURNITURE LIFT APPARATUS AND METHOD OF USE

(75) Inventors: Steve G. Payne, 369 Great Falls Rd., Collierville, TN (US) 38017; George L. Payne, Jr., Bartlett, TN (US)

(73) Assignee: Steve G. Payne, Collierville, TN (US)

( * ) Notice: Subject to any disclaimer, the term of this patent is extended or adjusted under 35 U.S.C. 154(b) by 0 days.

(21) Appl. No.: 10/818,119

(22) Filed: Apr. 5, 2004

(51) Int. Cl.[7] ..... F16M 11/24
(52) U.S. Cl. ..... 248/188.2; 5/509.1; 108/147.21
(58) Field of Search ..... 248/188.2, 188.3, 248/188.4; 5/509.1; 108/147.21

(56) References Cited

U.S. PATENT DOCUMENTS

| | | | |
|---|---|---|---|
| 2,366,867 | A | 1/1945 | Nichthauser |
| 2,893,164 | A | 7/1959 | Martin |
| 2,933,850 | A | 4/1960 | Martin |
| 3,232,253 | A | 2/1966 | Winters |
| 3,952,983 | A | 4/1976 | Crochet |
| 4,117,999 | A | 10/1978 | Gessler |
| 4,312,088 | A | 1/1982 | Webb |
| 5,060,896 | A | 10/1991 | Hobbins |
| 5,107,775 | A | 4/1992 | Langlais et al. |
| 5,205,097 | A | 4/1993 | Harvey |
| 5,224,227 | A | 7/1993 | McGinley |
| 5,333,825 | A | 8/1994 | Christensen |
| 5,345,631 | A | 9/1994 | Saperstein et al. |
| 5,615,429 | A | 4/1997 | Williams |
| D404,992 | S | 2/1999 | Sittig |
| 5,899,422 | A | 5/1999 | Eke |
| 6,012,185 | A | 1/2000 | Woods et al. |
| 6,575,414 | B2 * | 6/2003 | Cuzzocrea ..... 248/188.2 |
| 2001/0023509 | A1 * | 9/2001 | Becker et al. ..... 5/509.1 |

OTHER PUBLICATIONS

RomaLift furniture riser, Sammons Preston catalog at p. 79 (2000).

* cited by examiner

*Primary Examiner*—Ramon O Ramirez
(74) *Attorney, Agent, or Firm*—Walker, McKenzie & Walker, P.C.

(57) ABSTRACT

A furniture leg lifter in kit form for lifting a furniture leg of a large piece of furniture, one lifter per leg. The kit includes a base having an upwardly-opening recess; containment blocks, each with a central vertical opening, that are stacked atop the base and extend the recess upward; supporting blocks that are received within the recess for supporting the furniture leg; and a plurality of shim blocks of differing sizes. Selected parts from the kit are combined with the base to provide a selected lift distance for the furniture leg. The kit further includes a plurality of shim blocks of varying widths and lengths that are adapted to be closely packed around the furniture leg within the recess to restrain the furniture leg. Eye screws hold the containment blocks to the base. A non-skid bottom surface on the base prevents movement while supporting furniture.

8 Claims, 3 Drawing Sheets

FURNITURE LIFT APPARATUS AND METHOD OF USE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO COMPACT DISC(S)

Not applicable.

BACKGROUND OF THE INVENTION

1. Field of the Invention

The present invention relates, in general, to height adjustment of furniture, and in particular, to progressive lift apparatus for supporting furniture legs a distance above a floor surface.

2. Description of Related Art

It is often desired to adjust the height of a piece of furniture above a floor surface. Some prior art designs have also attempted to accommodate the wide variability of furniture leg widths commonly found on household furniture. In doing so, however, these prior art designs have often sacrificed stability and safety, or have become so large and complex as to be prohibitively cumbersome to use and/or expensive to manufacture for large articles of furniture such as beds and couches. Well-known solutions include telescoping legs for chairs and the like, and stackable assemblies, different in structure from the present invention, for placement under the furniture legs.

Prior art solutions have several problems that have not heretofore been solved. First, some prior art has very limited height adjustment. Second, some prior art has variable height adjustment but no capacity for adjustment to variable furniture leg widths. Third, some prior art has variable height adjustment and variable leg width adjustment, but lacks a non-skid surface on the underside to prevent furniture migration when slightly non-vertical forces are applied to the furniture piece. Fourth, some prior art solutions have proved to be unstable and therefore hazardous to those who sit on the furniture, especially if the sitter applies slightly non-vertical forces. Fifth, some prior art, while permitting height and width adjustments, requires the installer to crawl to the midpoint beneath the furniture, which is no small task when dealing with large, heavy pieces of furniture. Sixth, some prior art requires destruction of the furniture legs by drilling and subsequent insertion of elevating bolts and/or screws. Seventh, some prior art, apparently designed for kitchen and/or dining room chairs, when assembled under a bed or couch, would require much longer and heavier assembly pieces and relatively higher cost. Additionally, prior art solutions have proved to be unstable and therefore hazardous to those who sit on the furniture, especially if the sitter applies horizontal forces onto the piece of furniture while sitting, thereby exerting possibly-destabilizing forces on the piece of furniture.

It is therefore desirable to provide a furniture leg lift apparatus that adjusts to lift a furniture leg a selected height above a floor surface, and that accommodates a variety of furniture leg widths. It is further desirable to provide a furniture leg lift apparatus that is stable, compact, and that has simplicity of manufacture.

A preliminary patentability search in Classes 248 and 5, Subclasses 188.2 and 509.1, produced the following patents, some of which may be relevant to the present invention: Sittig, U.S. Design Pat. No. Des. 404,992 (issued Feb. 2, 1999); Nichthauser, U.S. Pat. No. 2,366,867 (issued Jan. 9, 1945); Martin, U.S. Pat. No. 2,893,164 (issued Jul. 7, 1959); Martin, U.S. Pat. No. 2,933,850 (issued Apr. 26, 1960); Winters, U.S. Pat. No. 3,232,253 (issued Feb. 1, 1966); Crochet, U.S. Pat. No. 3,952,983 (issued Apr. 27, 1976); Gessler, U.S. Pat. No. 4,117,999 (issued Oct. 3, 1978); Webb, U.S. Pat. No. 4,312,088 (issued Jan. 26, 1982); Hobbins, U.S. Pat. No. 5,060,896 (issued Oct. 29, 1991); Langlais et al., U.S. Pat. No. 5,107,775 (issued Apr. 28, 1992); Harvey, U.S. Pat. No. 5,205,097 (issued Apr. 27, 1993); McGinley, U.S. Pat. No. 5,224,227 (issued Jul. 6, 1993); Christensen, U.S. Pat. No. 5,333,825 (issued Aug. 2, 1994); Saperstein et al., U.S. Pat. No. 5,345,631 (issued Sep. 13, 1994); Williams, U.S. Pat. No. 5,615,429 (issued Apr. 1, 1997); Eke, U.S. Pat. No. 5,899,422 (issued May 4, 1999); and Woods et al., U.S. Pat. No. 6,012,185 (issued Jan. 11, 2000).

Additionally, a furniture riser sold under the trademark RomaLift is shown at page 79 of the Sammons Preston catalog for the year 2000.

None of these references, either singly or in combination, disclose or suggest the present invention.

BRIEF SUMMARY OF THE INVENTION

The present invention is a furniture leg lift apparatus, preferably provided as a kit, for lifting a furniture leg a distance above a floor. One furniture leg lift apparatus is required for each leg of a large article of furniture such as a bed or a couch or selected recliners. The kit includes a base block having a centrally-disposed recess formed therewithin and opening upwardly for receiving the furniture leg thereinto, and selected parts from the kit are combined with the base block to provide a selected lift distance for the furniture leg. The kit further includes a plurality of shim blocks of varying widths and lengths that are adapted to be closely packed around the furniture leg within the recess so as to restrain the furniture leg from substantial horizontal movement and to keep the furniture leg substantially centered on the apparatus. The kit also includes a plurality of containment blocks, each adapted for being stacked above the base block and having a vertical opening therethrough of substantially like horizontal dimensions as the recess so as to extend the recess upwardly when stacked above the base block, and the kit further includes a plurality of supporting blocks that are stacked above the base block within the recess and vertical openings so as to support the furniture leg at a selected distance above the floor. Eye screws preferably hold the containment blocks to the base block and allow easy assembly without tools, and a substantially non-skid bottom surface of the base block prevents movement of the apparatus while supporting a piece of furniture.

It is an object of the present invention to enable and empower persons who have physical impairments, such as physical weakness, to more easily rise from a seated position to a standing position by adjusting the height of furniture above the floor such that, when seated, the person's feet are flat on the floor and the person's hips are seated slightly higher than the person's knees. It is a further object of the present invention to be safe and simple to install and use without requiring the use of tools for assembly and adjustment, and to be inexpensive to manufacture.

DETAILED DESCRIPTION OF THE INVENTION

Figure 1:
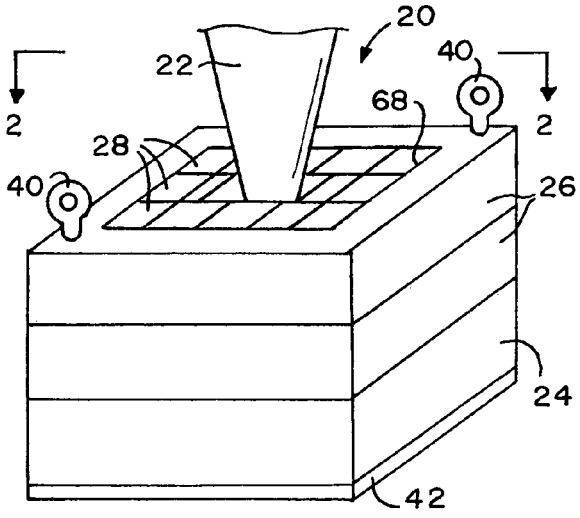
FIG. 1 is a front perspective view of the present invention shown supporting a furniture leg.

Referring to FIGS. 1–10 and 13, furniture lift apparatus 20, for supporting a furniture leg 22 a distance above a floor surface, is preferably provided in kit form and is seen to include a base block 24, a plurality of containment blocks 26, a plurality of filler or shim blocks (generally 28 and specifically 30, 32, 34, 36 shown in FIGS. 3–6), a plurality of supporting blocks 38, and fastener means, such as preferably a pair of eye screws 40, for selectively and removably fastening the containment blocks 26 to the base block 24. Base block 24 preferably has a substantially non-skid lower surface 42, which may be fashioned of any suitable material such as preferably a piece of well-known corrugated carpet runner material glued and/or stapled to the underside of base block 24.

Figure 8:
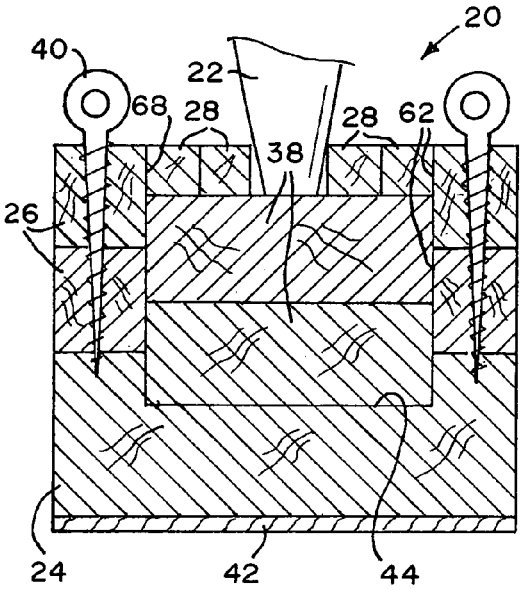
FIG. 8 is a sectional view of the present invention taken substantially along a diagonal and showing support of a furniture leg.

Base block 24 is preferably square in its transverse direction for increased stability, but could be of any shape such as, for example, rectangular or circular, as long as its horizontal width is greater than the lift distance from the floor to the bottom of the furniture leg. It should be understood that the vertical dimensions of the lift apparatus 20 as shown in the drawings are somewhat exaggerated with respect to the horizontal dimensions, simply for purposes of clarity in explanation and to show detail. When drawn in proper perspective with the same scale being used for horizontal dimensions and vertical dimensions, the horizontal width of the base block 24 of the preferred embodiment is about eight inches, and the furniture leg 22 as shown in FIG. 8 is lifted a distance of about 5.25 inches above the floor, thus preserving this relationship that the width of the base block 24 be greater than the lift distance from the floor to the bottom of the furniture leg. Base block 24 has a centrally-disposed and preferably square cavity or recess 44 formed therewithin and opening upwardly for receiving furniture leg 22 thereinto.

As best seen in FIGS. 3–6, the shim blocks 30, 32, 34, 36 are of substantially uniform height but are of differing lengths and widths so as to permit accommodation of various sizes of furniture legs 22. The shim blocks are adapted for being closely packed around the furniture leg 22 within the upwardly-extending recess of lift apparatus 20 so that the furniture leg is constrained to remain in the center of apparatus 20 without substantial horizontal movement within the recess. The close packing fit of the shim blocks causes them to be retained around the furniture leg.

Shim block 30 (see FIG. 3) has a first width dimension 46 and a first length dimension 48, with the first width being approximately one-half the height of the shim blocks. Shim block 32 (see FIG. 4) has a second width dimension 50 and a second length dimension 52, with the second width being substantially twice that of first width 46, and with the second length 52 being substantially twice that of first length 48. Shim block 34 (see FIG. 5) has a third width dimension 54 and a third length dimension 56, with the third width being substantially twice that of first width 46, and with the third length 56 being substantially equal to first length 48. Shim block 36 (see FIG. 6) has a fourth width dimension 58 and a fourth length dimension 60, with the fourth width being substantially equal to first width 46, and with the fourth length 60 being substantially twice that of first length 48.

Containment blocks 26 are stacked upon each other above base block 24 and each have a vertical opening 62 of substantially like horizontal dimensions as recess 44 such that, when stacked atop the base block 24 and upon each other, the openings 62 of containment blocks 26 extend recess 44 upwardly. Containment blocks 26 are preferably of the same height but could be of differing heights, if desired.

Figure 9:
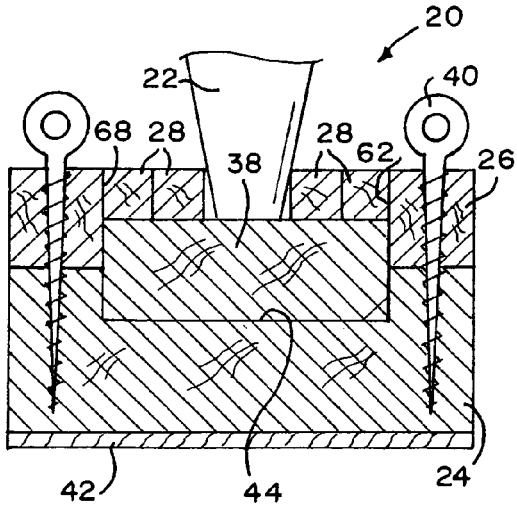
FIG. 9 is another sectional view of the present invention taken substantially along a diagonal, but showing support of a furniture leg at a lesser height than in FIG. 8.
Figure 10:
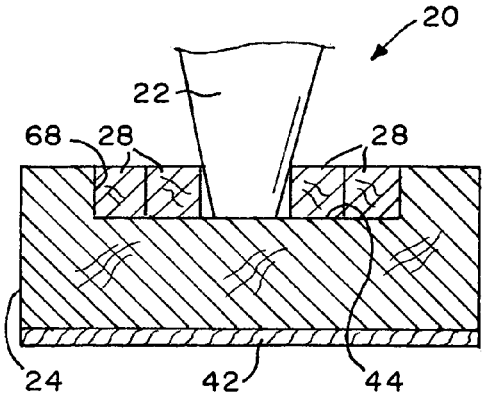
FIG. 10 is another sectional view of the present invention, shown supporting a furniture leg at a lesser height than in FIG. 9.

Supporting blocks 38 are preferably of the same height as containment blocks 26 and are of slightly smaller horizontal dimensions as recess 44 (and thus also vertical opening 62) so as to be easily received within recess 44 and vertical opening 62. As seen in FIGS. 8, 9, and 10, as different numbers of supporting blocks 38 are stacked within vertical opening 62 and recess 44, furniture leg 22 is caused to be supported a different distance above the floor. Gravity and the downward force of the furniture leg 22 hold the supporting blocks within the recess 44 and vertical opening 62 and also cause the substantially non-skid lower surface 42 of base block 24 to grip the floor.

The eye screws 40 extend through mating vertical bores 64, 66, at diagonal corners of the lift apparatus 20, that pass through the containment blocks 26 and partially extend into base block 24, with the diameter of bores 64, 66 being selected so that eye screws can be easily and tappingly threaded into the lift apparatus 20.

One preferred method for making each of the furniture leg lift apparatus 20 of the present invention is as follows. First, the various component parts are made:

(A) From a ¾ inch by 4 foot by 4 foot sheet of plywood, eight 8 inch by 8 inch squares are cut using a table saw.

(B) From five of the 8 inch by 8 inch squares, a 6 inch by 6 inch center hole is cut, using both a table saw and a saber saw. Each 8 inch by 8 inch square is placed on the table saw, with the saw blade positioned below the table. Then the spinning blade is raised upwards through the middle of each 6 inch side. Subsequently, the saber saw is used to finish out each corner of the 6 inch by 6 inch square hole.

(C) Into all eight 8 inch by 8 inch plywood squares, two 9/32 inch corner drill holes are made in opposite corners using a drill press.

(D) From the remaining 3/4 inch scrap plywood, four 5.75 inch by 5.75 squares for supporting blocks are cut using a table saw.

(E) From the remaining 3/4 inch scrap plywood, fifteen 1 31/32 inch by 31/32 inch rectangles are cut using a table saw.

(F) From the remaining 3/4 inch scrap plywood, two 1 31/32 inch by 15/32 inch rectangles are cut using a table saw.

(G) From the remaining 3/4 inch scrap plywood, two 31/32 inch by 31/32 inch rectangles are cut using a table saw.

(H) From the remaining 3/4 inch scrap plywood, four 31/32 inch by 15/32 inch rectangles are cut using a table saw.

(I) From a roll of 48 inch wide corrugated carpet runner, a 7/8 inch by 7/8 inch square is cut using a box cutter blade.

(J) From two 1/4 inch by 4.5 inch eye screws, 1/16 inch of the pointed tip is removed using an electric grinder.

Then, the component parts are assembled to form the invention:

(K) The three 8 inch by 8 inch plywood squares with solid centers created in step (A), above, are nailed together to form the lower part of the base block using finishing nails and a hammer.

(L) The carpet runner square created in step (I) above is attached to the selected bottom surface of the lower part of the base block formed in step (K) above, using 1/4 inch staples and an electric staple gun.

(M) One 8 inch by 8 inch plywood square with a 6 inch by 6 inch center hole, formed in step (B) above, is placed on top of the selected upper surface of the lower part of the base block, with corner drill holes aligned, and is then nailed to the upper surface of the lower part of the base block to form the full base block, using finishing nails and a hammer.

(N) The four remaining 8 inch by 8 inch plywood squares with 6 inch by 6 inch center holes, formed in step (B) above, are divided into pairs. Each pair is stacked with corner drill holes aligned and nailed together with finishing nails using a hammer, thereby forming the pair of double-height containment blocks 26.

(O) The pair of double-height containment blocks 26 formed in step (N) above is stacked atop the base block formed in step (M) above, with all corner drill holes aligned.

(P) The two modified eye screws formed in step (J) above are screwed into the two aligned sets of stacked drill holes of the assembly of step (O).

(Q) The corners of the assembly of step (P) are successively sanded approximately 1/4 inch along their entire length by placing the assembly on its side and using an electric sander, then serially rotating the assembly onto each successive side and similarly sanding the successive corners.

(R) The assembly is then placed into its upright position with the corrugated runner downward.

(S) The four 5.75 inch by 5.75 inch plywood squares formed in step (D) above are divided into pairs. Each pair is nailed together with finishing nails using a hammer, thereby forming the pair of double-height supporting blocks 38.

(T) The supporting blocks of step (S) above are inserted into the vertical recess of the assembly of step (R) above.

(U) The various-sized shim blocks formed in steps (E), (F), (G), and (H), above, are snugly inserted within the vertical recess atop the uppermost supporting block.

Layered plywood construction was chosen as the preferred manner of assembly to prevent warping and breakage because experimental testing showed that the lift apparatus 20, if constructed of solid wood, was prone to some warping and even breakage if stored at elevated temperature for a substantial period of time. Additionally, being constructed of wood, the lift apparatus 20 can be stained or painted if desired to match the decor of the lifted furniture or of the room in which the lift apparatus 20 is used.

The steps of the preferred Installation Instructions for the furniture lift apparatus 20 can now be given, emphasizing safety and careful attention to the instructions.

A plurality of furniture lift apparatus 20 are needed to lift a piece of furniture, with one furniture lift apparatus 20 being used to raise each furniture leg. The furniture leg lift apparatus 20 are designed to raise large furniture pieces approximately two to five inches higher than their original height, and are also designed to accept furniture legs that are up to six inches wide.

(1) Remove the small filler pieces (shim blocks) from the top of each furniture lift apparatus 20.

(2) Lift each furniture leg and place one furniture leg lift apparatus 20 beneath the leg.

Figure 2:
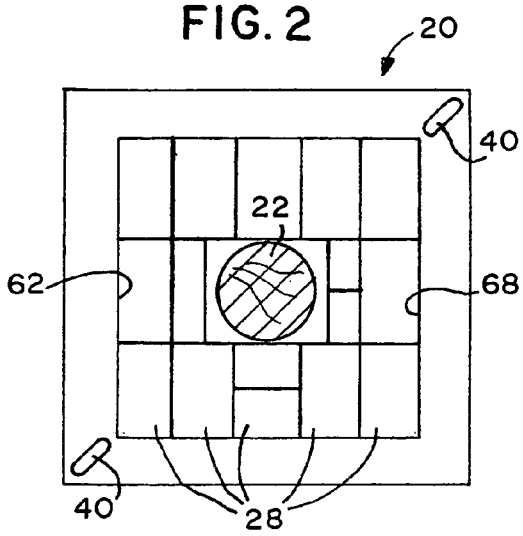
FIG. 2 is a top plan view of the present invention taken substantially along the line 2–2 shown in FIG. 1.
Figure 3:
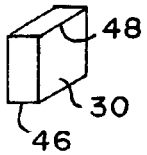
FIGS. 3, 4, 5 and 6 are perspective views of four of the shim blocks of the present invention, showing the variety in size and shape of the shim blocks.
Figure 4:
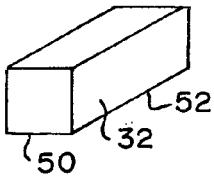
Figure 5:
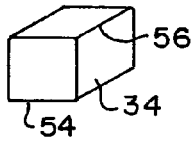
Figure 6:
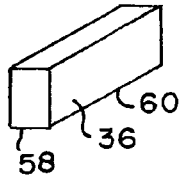
Figure 7:
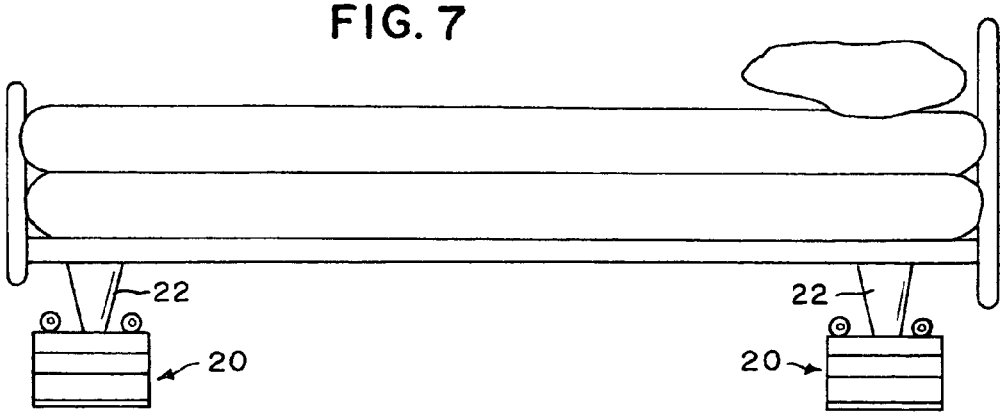
FIG. 7 is a front view showing the present invention supporting a piece of furniture such as a bed.

(3) Lower each furniture leg onto the center of its respective furniture leg lift apparatus 20 as shown in FIGS. 1 and 2.

(4) After placement of all furniture leg lift apparatus 20 beneath all furniture legs, recheck to be sure that each furniture leg is still in the center of its respective furniture leg lift apparatus 20. Adjust if necessary to center each leg on the furniture leg lift apparatus 20.

(5) To keep the furniture legs safely in the center of the furniture leg lift apparatus 20 during use, fill in any space between the rim 68 and the furniture leg by reinserting the filler pieces (shim blocks) that were removed in step (1) above. Note: place the largest filler pieces (shim blocks) close to the rim first, then fill in the space closer and closer to the furniture leg. It may be necessary to use the smaller filler pieces (shim blocks) close to the furniture leg to get a snug fit. All filler pieces (shim blocks) will not be needed.

(6) Have the person, for whom the height adjustment is being made, sit down safely near the edge of the seat on the piece of furniture. If the person's hips are seated slightly higher than the person's knees and if the person's feet are flat on the floor beneath the person's knees, then the furniture leg lift apparatus 20 are satisfactorily adjusted, and the installation is completed. If the seated person's hips are higher than the person's knees but the person's feet are not flat on the floor directly beneath the person's knees, then the furniture leg lift apparatus 20 are too high, and need to be lowered. If so, have the person vacate his seat and continue the installation procedure.

(7) Remove each of the furniture leg lift apparatus 20 from under each furniture leg.

(8) Remove all of the small filler pieces (shim blocks) from the top center area of each furniture leg lift apparatus 20 (as done before in step (1) above).

(9) Remove the topmost supporting block from the central recess of the furniture leg lift apparatus 20.

(10) Remove both of the eye screws.

(11) Remove the topmost containment block from the furniture leg lift apparatus 20.

(12) Replace each of the eye screws back into the screw holes of the remaining containment blocks and snug the eye screws gently.

(13) Repeat from step (2) through (6) above, checking for proper height adjustment and removing additional containment blocks and supporting blocks if additional lowering is needed. If all of the containment blocks and supporting blocks have been removed so that only the base block of the furniture leg lift apparatus 20 remains, the two eye screws should not be replaced, and the furniture leg lift apparatus 20 cannot be adjusted lower.

Figure 11:
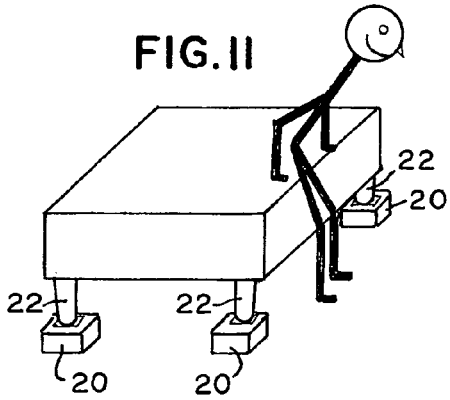
FIG. 11 is a diagrammatic view showing use of the present invention and a person rising from a seated position in which the person's hips are seated higher than the person's knees.
Figure 12:
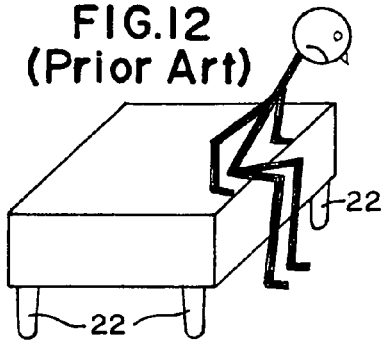
FIG. 12 (Prior Art)
FIG. 12 is a diagrammatic view of the prior art showing a person rising with difficulty from a seated position in which the person's hips are seated lower than the person's knees.
Figure 13:
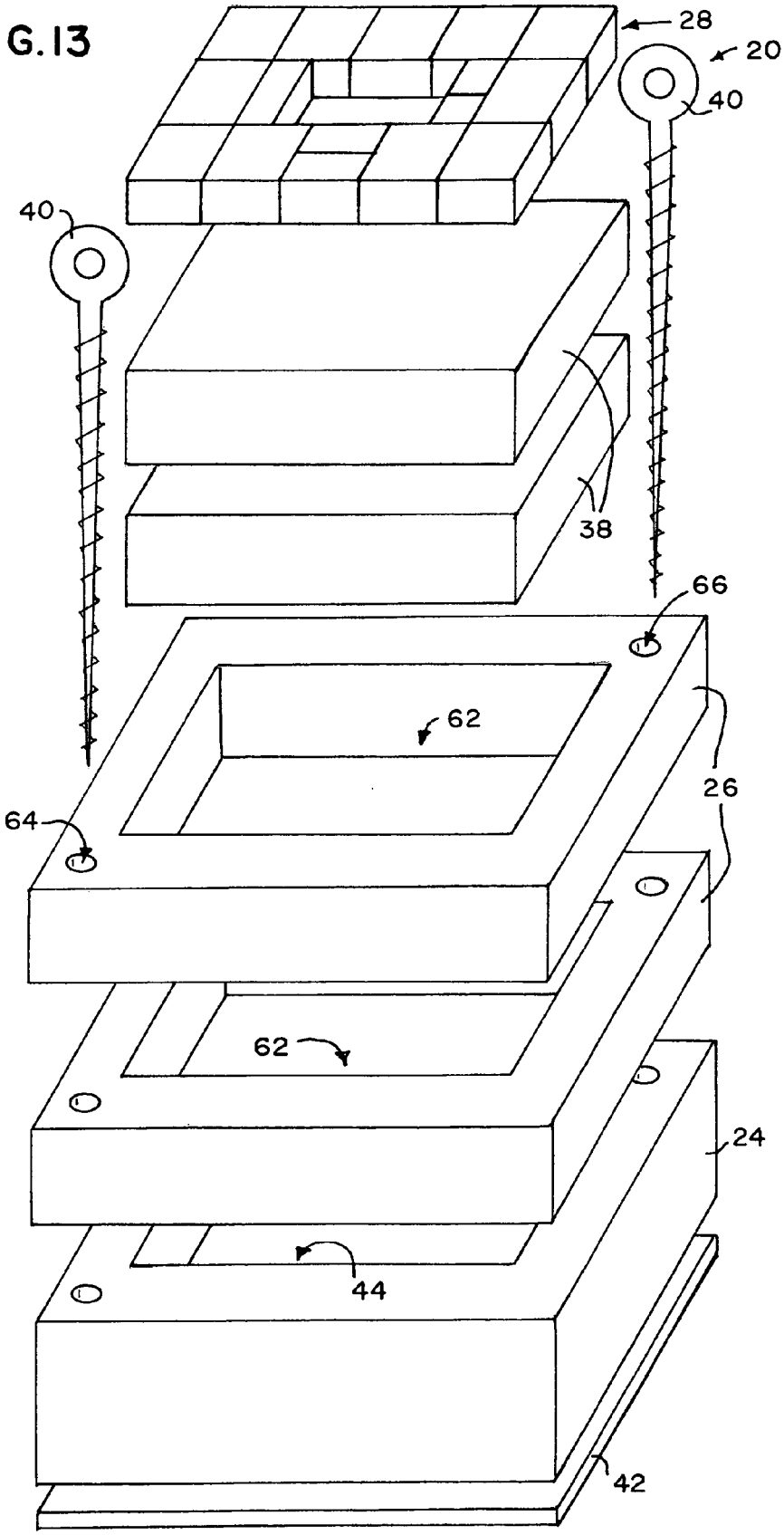
FIG. 13 is an exploded side perspective view of the present invention, showing the various parts thereof.

FIGS. 11 and 12 show how the present invention enables a person to rise from a seated position to a standing position more easily than without the present invention. FIG. 12 is a diagrammatic view of the prior art showing a person rising with difficulty from a seated position in which the person's hips are seated lower than the person's knees. The seating surface of the piece of furniture shown in FIG. 12 is seen to be too low, such that the person's hips are lower than the person's knees when in a seated position on the piece of furniture. Such a seated position, with one's hips lower than one's knees, is difficult to rise from, and the furniture lift apparatus of the present invention is needed to enable the person to stand up more easily.

FIG. 11 is a diagrammatic view showing use of the present invention and a person rising from a seated position in which the person's hips are seated higher than the person's knees. The following set of instructions shown in Table 1 preferably should be followed to enable a person to rise more easily from a seated position to a standing position:

TABLE 1

| How to Stand Up More Easily |
|---|
| 1. Scoot forward towards the edge of your seat. |
| 2. Place your feet directly beneath your knees and a few inches apart from one another. |
| 3. Place your hands on the seat near your hips. If sitting near armrests, place your hands on the armrests. |
| 4. Lean forward over your knees. |
| 5. Push yourself upright. |

As heretofore explained, the furniture lift apparatus of the present invention was invented to enable persons who have physical impairments, such as physical weakness, to more easily rise from a seated position to a standing position. For the safety not only of users of the present invention, but also for other members of their household such as loved ones, it is suggested that the instructions given in Table 1, above, and the cautionary warnings given in Table 2, below, be carefully studied before installing the furniture lift apparatus ("uplifters") of the present invention:

TABLE 2

| Warnings |
|---|
| 1. Uplifters are only intended for use under large pieces of furniture such as beds and couches. Uplifters are NOT SAFE for use under smaller, lighter pieces of furniture such as chairs. |
| 2. Furniture legs must be positioned and maintained near the center of each uplifter to be stable. Faulty furniture leg placement near the outer edge (rim) of the uplifter may cause the uplifter to be dislodged during use. |
| 3. Uplifters are designed to withstand normal downwards, sit-down forces. They may be dislodged by strong sideways forces such as someone falling back against the furniture. They may be dislodged by extreme bouncing, as with someone jumping up and down on the furniture piece. |
| 4. In some cases, properly installed uplifters may stick out slightly from under the edge of the furniture piece. Be aware of this positioning so that it does not become a safety problem as one walks past it. |
| 5. Some large articles of furniture have more than four legs. Before installing uplifters, be sure to assess how many legs the article of furniture has and be sure to install uplifters under all furniture legs. |
| 6. To ensure that the article of furniture is raised to a safe and level height, adjust all uplifters to the same level. |
| 7. Some large articles of furniture are significantly heavy. Be sure to acquire sufficient assistance for lifting heavy articles of furniture during placement of uplifters. |
| 8. Many persons with physical and mental impairments require supervision or assistance to stand up regardless of seat height elevation. Be sure to provide any needed supervision or physical assistance to ensure safety. |

Although the present invention has been described and illustrated with respect to a preferred embodiment and a preferred use therefor, it is not to be so limited since modifications and changes can be made therein which are within the full intended scope of the invention.

We claim:

1. A furniture leg lift apparatus for lifting a furniture leg a distance above a floor surface, said lift apparatus comprising:

(a) a base block, said base block having a centrally-disposed recess formed therewithin and opening upwardly for receiving said furniture leg thereinto;

(b) a plurality of shim blocks of substantially uniform height and adapted for being closely packed around said furniture leg within said recess so that said furniture leg is restrained from substantial horizontal movement within said recess, each of said plurality of shim blocks being selected from the set consisting of:

i. a first shim block having a first width and a first length;

ii. a second shim block having a second width and a second length, said second width being substantially twice said first width and said second length being substantially twice said first length;

iii. a third shim block having a third width and a third length, said third width being substantially twice said first width and said third length being substantially equal to said first length; and iv. a fourth shim block having a fourth width and a fourth length, said fourth width being substantially equal to said first width and said fourth length being substantially twice said first length.

2. A furniture leg lift apparatus for lifting a furniture leg a distance above a floor surface, said lift apparatus comprising:

(a) a base block, said base block having a centrally-disposed recess formed therewithin and opening upwardly for receiving said furniture leg thereinto;

(b) a plurality of shim blocks of substantially uniform height and adapted for being closely packed around said furniture leg within said recess so that said furniture leg is restrained from substantial horizontal movement within said recess;

(c) at least one containment block stacked above said base block and having a vertical opening therethrough of substantially like horizontal dimensions as said recess and in substantial alignment therewith so as to extend said recess upwardly;

(d) at least one supporting block of slightly smaller horizontal dimensions as said recess and said vertical opening and being received therewithin for supporting said furniture leg; and (e) fastener means for fastening said at least one containment block to said base block.

3. The furniture leg lift apparatus as recited in claim 2, in which said fastener means is an eye screw extending through said at least one containment block into said base block.

4. A furniture leg lift apparatus for lifting a furniture leg a distance above a floor surface, said lift apparatus comprising:

(a) a base block, said base block having a centrally-disposed recess formed therewithin and opening upwardly for receiving said furniture leg thereinto;

(b) a plurality of shim blocks of substantially uniform height and adapted for being closely packed around said furniture leg within said recess so that said furniture leg is restrained from substantial horizontal movement within said recess;

(c) at least one containment block stacked above said base block, said containment block having a first vertical opening therethrough of substantially like horizontal dimensions as said recess and in substantial alignment therewith so as to extend said recess upwardly;

(d) at least one supporting block of slightly smaller horizontal dimensions as said recess and said first and second vertical openings and being received therewithin for supporting said furniture leg; and (e) fastener means for fastening said at least one containment block to said base block.

5. The furniture leg lift apparatus as recited in claim 4, in which said fastener means is an eye screw extending through said at least one containment block into said base block.

6. A furniture leg lifter kit having component parts capable of being assembled as a furniture leg lift apparatus for lifting a furniture leg a distance above a floor surface, said kit comprising:

(a) a base block, said base block having a centrally-disposed recess formed therewithin and opening upwardly for receiving said furniture leg thereinto;

(b) a plurality of shim blocks of substantially uniform height and adapted for being closely packed around said furniture leg within said recess so that said furniture leg is restrained from substantial horizontal movement within said recess; each of said plurality of shim blocks being selected from the set consisting of:

i. a first shim block having a first width and a first length;

ii. a second shim block having a second width and a second length, said second width being substantially twice said first width and said second length being substantially twice said first length;

iii. a third shim block having a third width and a third length, said third width being substantially twice said first width and said third length being substantially equal to said first length; and iv. a fourth shim block having a fourth width and a fourth length, said fourth width being substantially equal to said first width and said fourth length being substantially twice said first length;

(c) a plurality of containment blocks each adapted for being stacked above said base block and having a vertical opening therethrough of substantially like horizontal dimensions as said recess and in substantial alignment therewith so as to extend said recess upwardly when stacked above said base block;

(d) a plurality of supporting blocks of slightly smaller horizontal dimensions as said recess and said vertical opening, each adapted for being received therewithin for supporting said furniture leg; and (e) fastener means for fastening at least one of said containment blocks to said base block.

7. The furniture leg lifter kit as recited in claim 6, in which said fastener means is an eye screw adapted for extending through said at least one of said containment blocks into said base block.

8. The furniture lift apparatus as recited in claim 6, in which said base block has a substantially non-skid lower surface.

* * * * *